United States Patent [19]

Kurose

[11] 3,953,979

[45] May 4, 1976

[54] CONCRETE WALL BLOCKS AND A METHOD OF PUTTING THEM TOGETHER INTO A RETAINING WALL

[76] Inventor: Masayuki Kurose, 2208 Kodago, Nagayo-cho, Nishisonogi, Nagasaki, Japan

[22] Filed: Sept. 6, 1974

[21] Appl. No.: 503,635

[30] Foreign Application Priority Data

Sept. 14, 1973 Japan ..... 48-104250

[52] U.S. Cl. ..... 61/39; 61/4; 61/47; 61/49; 52/437

[51] Int. Cl.[2] ..... E02D 5/20; E02B 3/14

[58] Field of Search ..... 61/37, 39, 50, 47, 49, 61/4, 35; 52/437, 592, 607

[56] References Cited

UNITED STATES PATENTS

| | | | |
|---|---|---|---|
| 3,347,048 | 10/1967 | Brown et al. | 61/37 |
| 3,379,017 | 4/1968 | Kusatake | 61/47 |
| 3,597,925 | 8/1971 | Kusatake | 61/4 |
| 3,653,216 | 4/1972 | Stickler, Jr. | 61/4 |

FOREIGN PATENTS OR APPLICATIONS

| | | | |
|---|---|---|---|
| 1,253,821 | 11/1971 | United Kingdom | 61/47 |
| 1,137,391 | 12/1968 | United Kingdom | 61/4 |
| 1,124,899 | 3/1962 | Germany | 52/592 |

*Primary Examiner*—Jacob Shapiro
*Attorney, Agent, or Firm*—Basile and Weintraub

[57] ABSTRACT

Specially shaped concrete wall blocks which can be readily put together to form a retaining wall which is not easily collapsible. The block of the H-shaped construction comprises a front wall, a rear wall which is parallel to the front wall and a member connecting the front and rear walls. The front wall is of the integrally formed three-part construction. Two of the parts are diagonally offset relative to each other by an intermediate rhomboidal portion interposed therebetween. The sloping surfaces formed around the front wall by the rhomboidal portion provides means for holding together the blocks assembled into a retaining wall. According to one embodiment of the invention, the block is shaped in the form of a regular H while it is in the form of an inclined H according to another embodiment.

2 Claims, 9 Drawing Figures

CONCRETE WALL BLOCKS AND A METHOD OF PUTTING THEM TOGETHER INTO A RETAINING WALL

This invention relates to specially shaped concrete wall blocks for use in the construction of a retaining wall, and a method of constructing such a retaining wall by using those blocks.

According to the method of constructing a retaining wall known in the art, soft earth is first removed from the entire area of a bank, cliff or the like to be protected by the retaining wall. This work requires a lot of time and labor and the known method is further objectionable because there is every likelihood that the ground may collapse during the construction of the wall due to a rainfall or other causes. The known method uses commercially available blocks of standard sizes, or alternatively, a concrete retaining wall of unitary construction having a large cross-section is constructed to protect the bank, etc. by gravity. But the standard blocks heretofore available in the art cannot endure a great load imposed by the earth of the bank, etc. The retaining wall of unitary construction requires removal of earth over an enlarged area of the bank, etc.

An object of this invention is to provide blocks for use in the construction of a retaining wall which can be mass-produced in a factory at a low cost and can easily be transported to the place where a retaining wall should be constructed, and which can easily be suspended by a wire rope without any fear of slipping down.

Another object of this invention is to provide blocks for constructing a retaining wall which are applicable to either a vertical plane or a sloping plane.

Still another object of this invention is to provide blocks for constructing a retaining wall which are shaped for easy and sure arrangement both in rows and in columns.

A further object of this invention is to provide blocks for constructing a retaining wall which are lightweight and provide the wall with a large effective thickness to impart to it a sufficient strength against the earth load.

A still further object of this invention is to provide a method of constructing a strong retaining wall wherein the place where the retaining wall is to be constructed is divided into a plurality of sections each having a width equal to the combined width of several blocks, and a part of the wall is constructed in one section after another after removal of soft earth therefrom to eventually complete the whole wall.

Other objects and features of this invention will become apparent from the following description and the accompanying drawings, in which.

Figure 1:
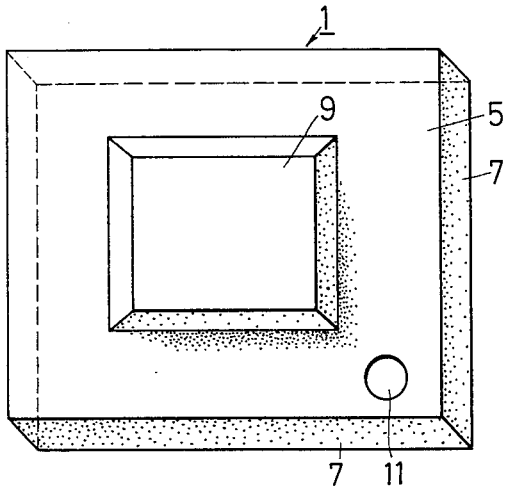
FIG. 1 is a front elevational view of a block according to a preferred embodiment of this invention.
Figure 2:
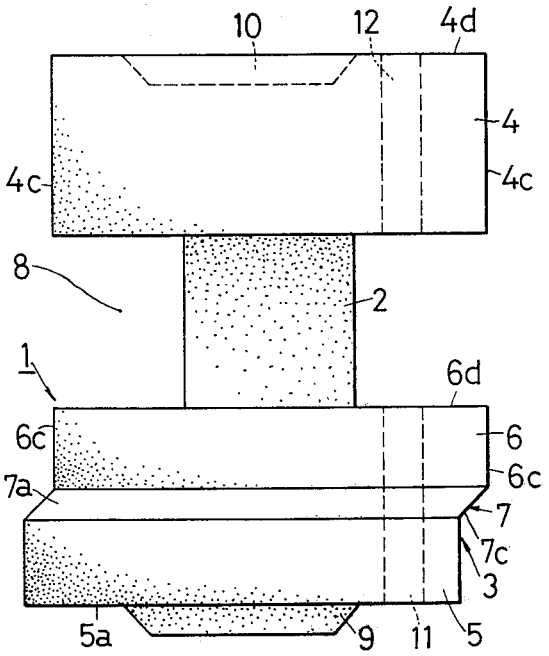
FIG. 2 is a top plan view of the block shown in FIG. 1.
Figure 3:
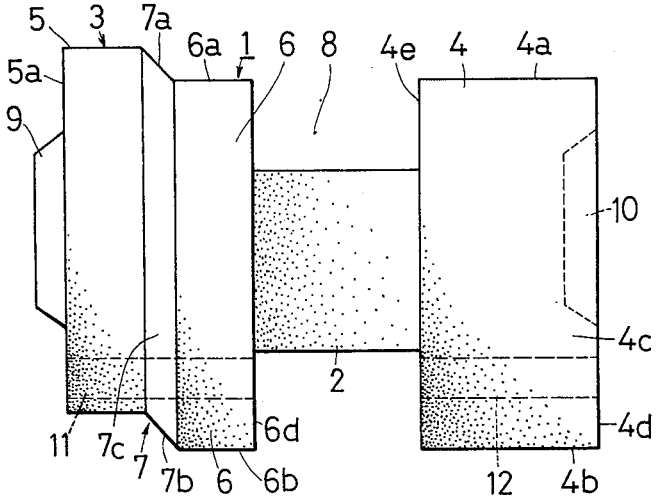
FIG. 3 is a side elevational view of the block of FIG. 1.
Figure 4:
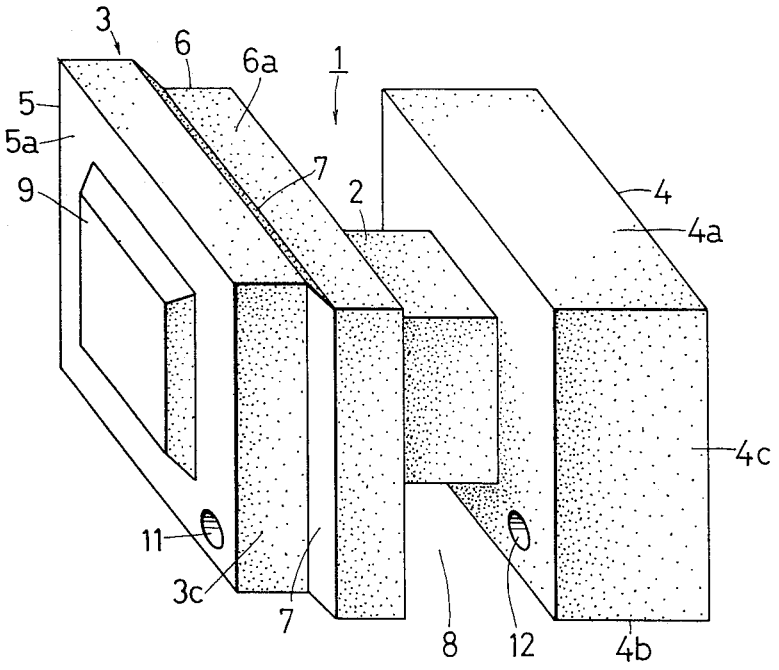
FIG. 4 is a perspective view of the block of FIG. 1.

Referring now to the drawings, more particularly to FIGS. 1 through 4, an H-shaped block 1 comprises a front wall 3, a rear wall 4 and a square or cylindrical connection member 2 with which the front wall 3 and the rear wall 4 are connected to each other (see FIG. 3). The front wall 3 consists of two rectangular parallelepipedic portions, i.e., a front part 5 and a rear part 6 of which the rectangular front surfaces are of the same size. The rear part 6 is parallel to the front part 5 and is diagonally offset relative to the front part 5 by an intermediate rhomboidal solid portion 7 integrally formed with the front and rear portions 5 and 6. The rear wall 4, of which the front surface has the exactly same shape as the front surface of the rear part 6 of the front wall 3, is in alignment with the rear part 6 longitudinally of the block 1. In other words, the upper surface 6*a*, the lower surface 6*b* and the opposite side surfaces 6*c* of the rear part 6 of the front wall 3 lie in the same horizontal or vertical planes with the upper surface 4*a*, the lower surface 4*b* and the opposite side surfaces 4*c*, respectively, of the rear wall 4. The front face 4*e* of the rear wall 4 is connected with the rear face 6*d* of the rear part 6 of the front wall 3 by means of the connection member 2. The connection member 2 is spaced inwardly from the edges of the rear part 6 of the front wall 3 and of the rear wall 4, and a hollow space 8 encircling the member 2 is formed between the rear part 6 of the front wall 3 and the rear wall. A trapezoidal projection 9 is provided at the center of the front surface 5*a* of the front part 5 of the front wall 3, and the rear surface 4*d* of the rear wall 4 is provided with a complementary concavity 10 in which the projection 9 of another block 1 can be fit to form a sort of spigot and socket connection between two longitudinally adjoining blocks 1. Numerals 11 and 12 indicate drain holes provided through the lower corners of the front wall 3 and the rear wall 4, respectively, in mutually coaxial relationship.

Figure 5:
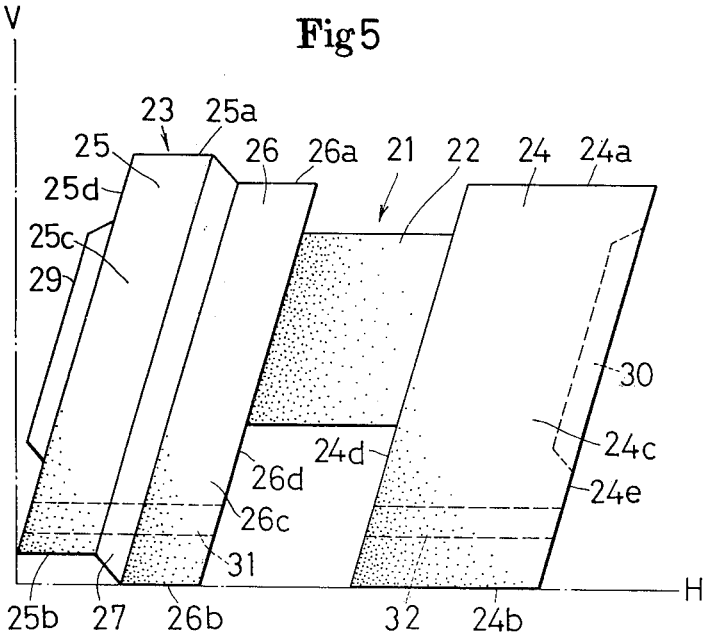
FIG. 5 is a side elevational view of the block according to another embodiment of this invention.

A block 21 shown in FIG. 5 is a modification of the block 1 shown in FIGS. 1 through 4. The block is shaped in the form of an inclined H to be applied to a sloping plane of the earth. The inclined H-shaped block 21 consists of a front wall 23 inclined rearwardly at an angle to the horizontal, a rear wall 24 also inclined rearwardly at the same angle and a square or cylindrical connection member 22 parallel to the horizontal by means of which the front wall 23 and the rear wall 24 are connected to each other. The front wall 23 consists of two parallelepipedic parts, i.e., a front part 25 and a rear part 26 of which the rectangular front surfaces are of the same size. The rear part 26 is parallel to the front part 25 and is diagonally off-set relative to the front part 25 by an intermediate rhomboidal portion 27 integrally formed with the front part 25 and the rear part 26. The rear wall 24, the front surface 24*d* of which has the exact same shape and is inclined at the same angle as the front surface of the rear part 26 of the front wall 23, is in alignment with the rear part 26 of the front wall 23. The front face 25*d* of the front part 25, the rear face 26*d* of the rear part 26, and the front and rear faces 24*d* and 24*e* of the rear wall 24 are inclined at the same angle in respect to a vertical plane V, and the upper and lower surfaces 25*a* and 25*b* of the front part 25, the upper and lower surfaces 26*a* and 26*b* of the rear part 26 and the upper and lower surfaces 24*a* and 24*b* of the rear wall 24 are all parallel to a horizontal plane H. And the side surfaces 25*c*, 26*c* and 24*c* of the front part 25, the rear part 26 and the rear wall 24 respectively are all parallel to a vertical plane V at right angles thereto. As mentioned above, the rear wall 24 is right behind the rear part 26 of the front wall 23, and the upper surface 24*a* of the rear wall 24 is level with the upper surface 26*a* of the rear part 26 and the lower surface 24*b* of the rear wall 24 is level with the lower surface 26*b* of the rear part 26. One of the side surfaces 24*c* of the rear wall 24 and one of the side surfaces 26*c* of the rear part 26 are in the same vertical plane which meets at right angles with the vertical plane V. A trapezoidal projection 29 is provided at the center of the front surface 25*d* of the front part 25 of the front wall 23, and the rear surface 24*d* of the rear wall 24 is provided with a complementary concavity 30 in which the projection 29 of another block 21 can be fit to form a sort of spigot and socket connection between two longitudinally adjoining blocks 21. Numerals 31 and 32 indicate drain holes provided through the lower corners of the front wall 23 and the rear wall 24, respectively, in mutually coaxial relationship.

Now, description will be made of a method of constructing a retaining wall with the blocks 1 of FIGS. 1 through 4.

First, the place where a retaining wall should be constructed is divided into a plurality of sections each of which has a width equal to the combined width of two to four blocks. And after judging the firmness of the ground of each section, the ground cutting of the height required is performed at the roadside to make a vertical plane N.

Then, piles P are driven in the ground to form a base B. When the base B is established, a first block 1 is placed on the base B. In placing the block 1 onto the base B, the hollow space 8 encircling the connection member 2 of the block 1 may conveniently be entwined with a rope, a chain etc. and may be considered as an effective means to give stability to the block 1 in case of suspension and conveyance thereof. The block 1 is placed on the base B with the rear surface 4*d* of the rear wall 4 pressed against the vertical plane N.

When it is finished to place the first block 1 on the base B, another block or blocks 1 may be placed close to one side or both sides of the first block 1 on the base B in the same manner as mentioned above. On this occasion, two adjacent blocks are contacted with each other, and then a side surface 7*c* of the rhomboidal solid portion 7 of one of the two adjacent blocks is contacted with a corresponding side surface 7*c* of the rhomboidal solid portion 7 of the other block so as to prevent the two adjacent blocks from being moved back and forth. Thus, the placement of blocks in the first or lowermost row in one section is finished.

Figure 6:
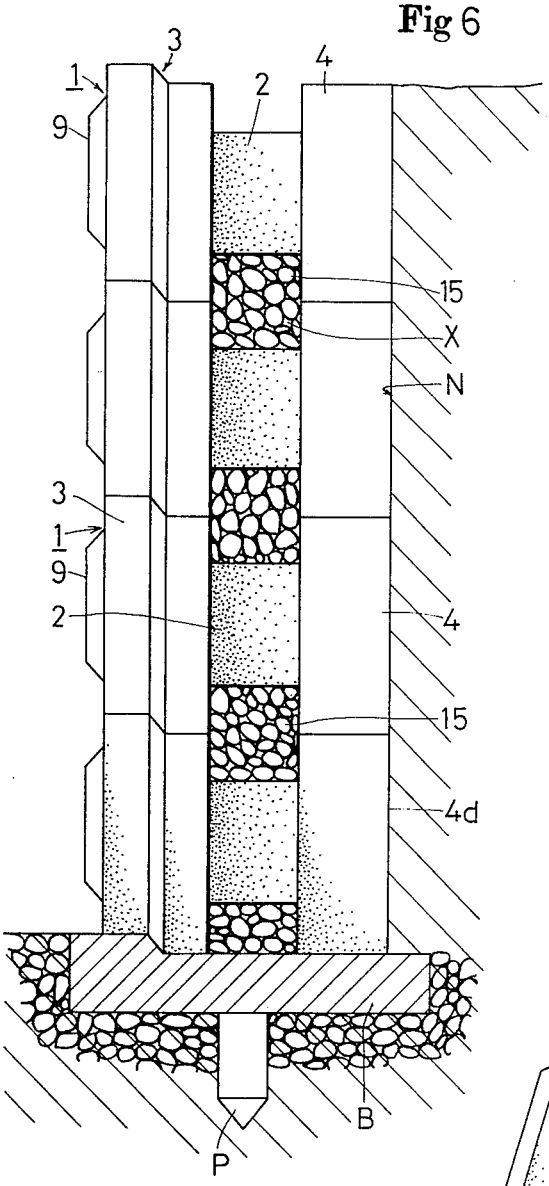
FIG. 6 is a side elevational view of a retaining wall constructed with the blocks of FIG. 1.
Figure 9:
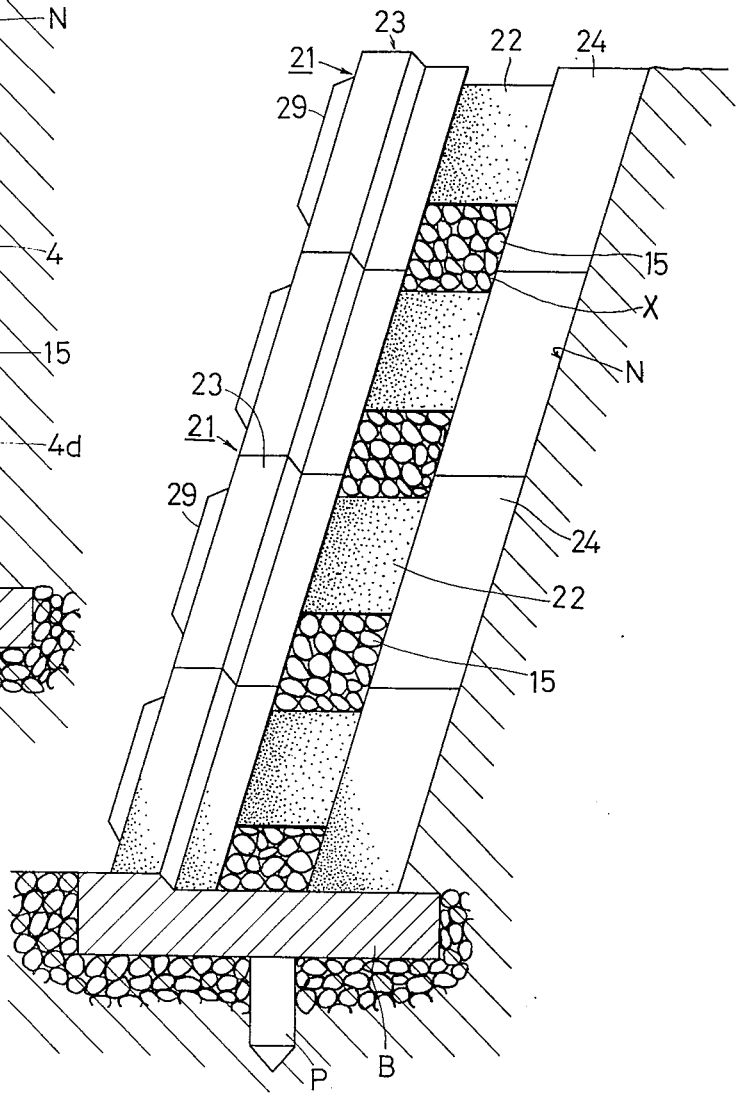
FIG. 9 is a side elevational view of an inclined retaining wall constructed with the blocks of FIG. 5.
Figure 7:
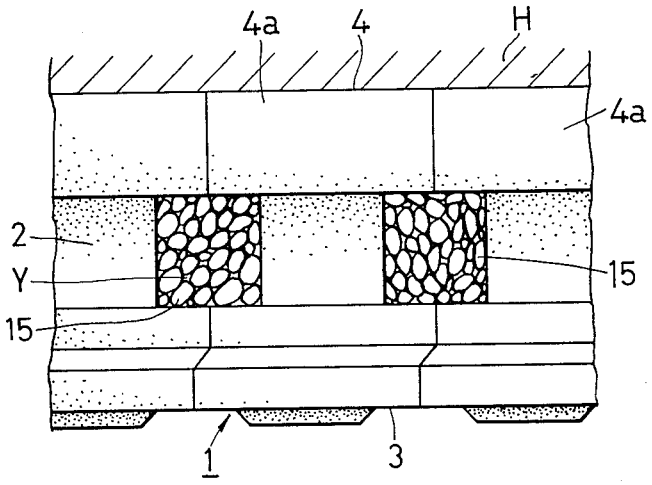
FIG. 7 is a partial top plan view of the retaining wall of FIG. 6.

Then, fillers 15 such as cobble stones, raw concrete or the like are poured into vertical and lateral slit-like spaces X and Y which are formed by the connection member of each block 1. Thus, the first row of a block wall is completed. Next, the second row of blocks 1 are placed on the first row of block wall. In this case, the lower surface 7*b* of the rhomboidal portion 7 of the block 1 in the second row is fitted to the upper surface 7*a* of the rhomboidal portion 7 of the block 1 in the first row so as to form a vertical plane with the front surface 5*a* of each block 1 (see FIG. 6). When the placement of the blocks 1 in the second row is finished, the vertical and lateral slit-like spaces X and Y formed by the connection member 2 of each block 1 are filled with fillers 15 in the same manner as mentioned above.

Figure 8:
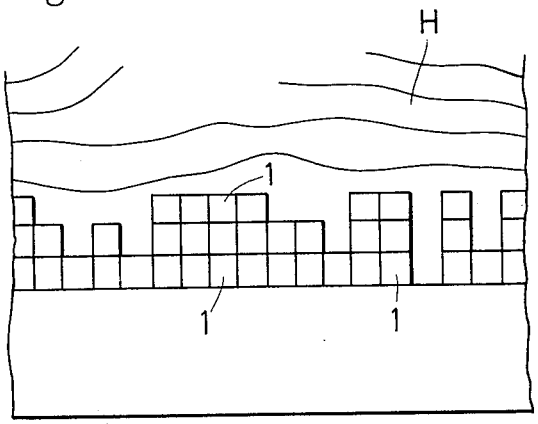
FIG. 8 is a front elevational view of a finished retaining wall.

Thereafter, the third and further rows of blocks are placed one upon another along the cut plane of the earth. After a section of the retaining wall has been constructed, the other sections adjacent to the constructed section are to be constructed by turns in the same manner as mentioned above so that the whole of the retaining wall may be built up (see FIG. 8).

In case it is needed to arrange a couple of blocks 1 in longitudinal alignment, the projection 9 of the front wall 3 of a block 1 is to be engaged with the complementary concavity 10 of the rear wall 4 of the other block 1.

In case of constructing a retaining wall along a sloping plane of the earth at a given angle, inclined H-shaped blocks 21 are used instead of the blocks 1 so as to construct the retaining wall in the same manner as mentioned above.

What is claimed is:

1. A block for use in the construction of a retaining wall, said block having a longitudinal axis and comprising:

a generally vertical first wall having a rectangular vertical cross-section transversely to said longitudinal axis of said block;

a generally vertical second wall disposed opposite to said first wall and parallel thereto and having a rectangular vertical cross-section transversely to said longitudinal axis of said block;

a horizontal member interconnecting said first and second walls approximately in the centers thereof and having a rectangular cross-section transversely to said longitudinal axis of said block, said cross-section of said horizontal member being smaller than said cross-sections of said first and second walls;

said first wall having an inner portion connected to said horizontal member, an outer portion adapted to form an exposed surface portion of said retaining wall, and a middle portion interposed between said inner and outer portions;

said inner portion having a pair of horizontal surfaces lying in the respective horizontal planes of a pair of horizontal surfaces of said second wall and a pair of vertical surfaces lying in the respective vertical planes of a first pair of vertical surfaces of said second wall which are parallel to said longitudinal axis of said block, said inner portion further including a third vertical surface which is perpendicular to said longitudinal axis of said block and to which said horizontal member is connected at one end;

said second wall having a second pair of vertical surfaces perpendicular to said longitudinal axis of said block, said horizontal member being connected at the other end to one of said second pair of vertical surfaces;

said first wall middle portion being defined by a pair of horizontally extending flat surfaces and a pair of vertically extending flat surfaces which are all inclined at an equal angle to said longitudinal axis of said block, whereby said first wall outer portion is diagonally offset relative to said inner portion;

said first wall outer portion having a vertical surface located on the opposite side of said middle portion from said third vertical surface of said inner portion;

said vertical surface of said outer portion having a flat, rectangular outwardly tapered boss perpendicular to said longitudinal axis of said block;

the other of said second pair of vertical surfaces of said second wall being provided with an inwardly tapered, rectangular recess which is complementary to said boss and is horizontally alignable therewith, said boss and said recess extending along said longitudinal axis of said block and lying substantially in a common horizontal plane with said horizontal member;

said first wall having a drain hole extending through said inner, middle, and outer portions and parallel to said longitudinal axis of said block; and said second wall having a drain hole extending therethrough coaxially with said drain hole of said first wall.

2. The block as defined in claim 1 wherein said third vertical surface of said inner portion, said second pair of vertical surfaces of said second wall and said vertical surface of said first wall outer portion are inclined at an equal angle to the vertical.

* * * * *

UNITED STATES PATENT AND TRADEMARK OFFICE

CERTIFICATE OF CORRECTION

PATENT NO. : 3,953,979

DATED : May 4, 1976

INVENTOR(S) : Masayuki Kurose

It is certified that error appears in the above-identified patent and that said Letters Patent are hereby corrected as shown below:

Page 1, following the inventor's name and address insert the following new paragraph:

--[73] Assignee: Giken Kogyo Kabushiki Kaisha
Tokyo, Japan--

Signed and Sealed this

Nineteenth Day of October 1976

[SEAL]

*Attest:*

RUTH C. MASON
*Attesting Officer*

C. MARSHALL DANN
*Commissioner of Patents and Trademarks*